US006092798A

United States Patent [19]

Hiratuka et al.

[11] Patent Number: 6,092,798

[45] Date of Patent: Jul. 25, 2000

[54] TICKET ISSUING APPARATUS

[75] Inventors: Shuuiti Hiratuka; Takahiro Amada, both of Takasaki; Ryuji Ishii, Tokyo; Sadao Sone, Tokyo; Masatoshi Kawaji, Tokyo; Takashi Okada, Tokyo, all of Japan

[73] Assignee: Oki Electric Industry Co., Ltd., Tokyo, Japan

[21] Appl. No.: 09/029,091

[22] PCT Filed: Aug. 29, 1996

[86] PCT No.: PCT/JP96/02423

§ 371 Date: Feb. 18, 1998

§ 102(e) Date: Feb. 18, 1998

[87] PCT Pub. No.: WO97/08662

PCT Pub. Date: Mar. 6, 1997

[30] Foreign Application Priority Data

Aug. 31, 1995 [JP] Japan ..... 7-223345

[51] Int. Cl.[7] ..... B42B 2/00; B65H 29/70; B65H 15/00; G03G 15/00

[52] U.S. Cl. ..... 270/52.12; 271/188; 226/49; 399/384

[58] Field of Search ..... 270/52.12, 52.03; 271/3.2, 3.18, 161, 207, 188, 902; 399/384; 226/49, 110, 115

[56] References Cited

U.S. PATENT DOCUMENTS

| | | | |
|---|---|---|---|
| 4,416,378 | 11/1983 | Miller . | |
| 4,591,259 | 5/1986 | Kuo et al. | 355/3 X |
| 4,607,942 | 8/1986 | Koyama et al. | 355/3 X |
| 4,627,718 | 12/1986 | Wyer | 355/35 X |
| 4,650,176 | 3/1987 | Sugizaki et al. | 271/225 X |
| 4,761,001 | 8/1988 | Hayakawa et al. | 271/3.1 X |
| 4,974,827 | 12/1990 | Arai et al. | 271/265 X |
| 5,288,062 | 2/1994 | Rizzolo et al. | 270/53 X |
| 5,451,037 | 9/1995 | Lundstrom | 270/1.1 X |
| 5,785,224 | 7/1998 | Nawakowski | 225/4 X |

FOREIGN PATENT DOCUMENTS

| | | |
|---|---|---|
| 0 197 722 | 10/1986 | European Pat. Off. . |
| 0 473 137 | 3/1992 | European Pat. Off. . |

*Primary Examiner*—Jospeh E. Valenza
*Assistant Examiner*—Kenneth W. Bower
*Attorney, Agent, or Firm*—Rabin & Champagne, PC

[57] ABSTRACT

A ticket issuing apparatus includes a feed passage which is branched into plural guides at one end thereof which are connected with each of a plurality of medium accommodating parts and arranged in strata, and merged into one. The apparatus has a feed passage which passes through the upper, rear and lower parts of the medium accommodating parts in this order and is guided to a front wall thereof. A medium separating part, a magnetic processing part and a printing part are respectively disposed along the feed passage, and a discharge stacker is connected with the other end of the feed passage. The medium handling apparatus removes curl of the medium before it is issued by returning the medium to the medium accommodating parts by a given amount.

8 Claims, 6 Drawing Sheets

TICKET ISSUING APPARATUS

TECHNICAL FIELD

The present invention relates to a medium handling apparatus, such as a desktop ticket issuing apparatus connected with a host machine for issuing tickets, and a medium handling method used when issuing the tickets.

BACKGROUND TECHNOLOGY

A conventional medium handling apparatus will be now described by exemplifying a ticket issuing apparatus which is connected with a host machine for issuing tickets.

The conventional medium handling apparatus comprises a plurality of hoppers for accommodating therein a rectangular ticket sheet which is folded along perforations, a medium separating part for separating the ticket sheet, a magnetic processing part for writing magnetic data into the ticket sheet, a printing part for printing printing data onto the ticket sheet, and a discharge stacker for discharging the ticket sheet. The plurality of hoppers are arranged horizontally and disposed at the lower part of a housing. The medium separating part, magnetic processing part, printing part and discharge stacker are respectively arranged horizontally and disposed at the upper part of each hopper. With this medium handling apparatus, the ticket sheets are drawn out from each hopper with a bellows shape, and they are separated, one by one, along the perforations by the medium separating part. A given magnetic data is written into a magnetic stripe provided at the back of the ticket sheet by the magnetic processing part. Then a given printing data is printed by the printing part onto the front side of the ticket sheet in the printing position. Finally the ticket sheet is discharged to the discharge stacker.

The conventional medium handling apparatus has such a structure that the medium separating part, magnetic processing part and printing part are respectively arranged horizontally and disposed at the upper parts of the hoppers, and the ticket sheet is drawn out from each hopper in the shape of a bellows and guided to these components. Accordingly, there occurs a problem that a space is needed for arranging the medium separating part, magnetic processing part and printing part respectively horizontally and disposing them at the upper parts of the hoppers, and another space is needed for drawing out the ticket sheet in the shape of a bellows, which makes the apparatus large-sized.

Further, the conventional medium handling apparatus draws out the ticket sheet in the shape of a bellows then bends the ticket sheet and holds the ticket sheet in a bent state to prevent the ticket sheet from being deformed. However, when the ticket sheet is issued upon elapse of a given time, the ticket sheet which is first issued from the apparatus curls by the heat generated therein, which is unpleasant to the touch by a client who receives the ticket sheet.

It is an object of the present invention to provide a small-sized ticket issuing apparatus capable of issuing the ticket sheet without deforming it.

DISCLOSURE OF THE INVENTION

A medium handling apparatus according to a first aspect of the invention comprises a plurality of medium accommodating parts for accommodating a medium therein, a plurality of guides respectively having one end connected with each of the medium accommodating parts and disposed in strata. The guides other ends are merged into one to form.

A first feed passage, a second feed passage has one end connected with the first feed passage. A medium separating part is provided for separating the medium into a given size. A magnetic processing part is provided for writing a given magnetic data into the medium. A printing part is provided for printing given data onto the medium, and a discharge stacker is provided for discharging the medium. A feed passage formed by the first and second feed passages is disposed to pass through upper, rear and lower portions of the plurality of medium accommodating parts in this order, and is guided to a front wall of the apparatus. The medium separating part, magnetic processing part and printing part are respectively disposed along the second feed passage. The discharge stacker is disposed at the front wall of the apparatus and is connected with another end of the second feed passage.

The first aspect of the invention can provide a small-sized medium handling apparatus.

A medium handling apparatus according to a second aspect of the invention is characterized in that it further comprises in the first aspect of the invention a circular arc-shaped part disposed on the second feed passage for changing a direction of the medium toward said discharge stacker, a first insertion port disposed under the discharge stacker for inserting the medium from an outside of the apparatus into an inside of the apparatus, and a third feed passage having one end connected with the first insertion port, and another end connected with the second feed passage at the circular arc-shaped part for feeding the medium inserted from the first insertion port to the second feed passage.

The second aspect of the invention can provide a medium handling apparatus capable of inserting a medium from the outside of the apparatus at the front side thereof to the inside thereof.

A medium handling apparatus according to a third aspect of the invention is characterized in that it further comprises in the second aspect of the invention detecting means disposed on the second or third feed passage for discriminating a length of medium inserted through the first insertion port, and a blade disposed at the circular arc part for changing a direction of the medium toward the discharge stacker.

The third aspect of the invention can provide a medium handling apparatus capable of discriminating the length of medium and changing the feeding direction of the medium toward the discharge stacker.

A medium handling apparatus according to a fourth aspect of the invention is characterized in that it further comprises in the first aspect of the invention a second insertion port disposed at a back wall of the apparatus for inserting the medium from an outside of the apparatus into an inside of the apparatus, and a fourth feed passage having one end connected with the second insertion port, and another end connected with the first or second feed passage at backs of the plurality of medium accommodating parts for feeding the medium inserted from the second insertion port to a feed passage formed by the first and second feed passages.

The fourth aspect of the invention can provide a medium handling apparatus capable of inserting medium from the outside of the apparatus at the back thereof to the inside thereof.

A medium handling apparatus according to a fifth aspect of the invention has a feed passage for feeding a medium, a circular arc-shaped part disposed on the feed passage for changing a direction of the medium to be fed along the feed passage, and a pressing member disposed at an upper or a lower part of the circular arc-shaped part for making a feeding distance of the medium constant.

The fifth aspect of the invention can provide a medium handling apparatus capable of making the feeding distance of the medium constant.

A medium handling method according to a sixth aspect of the invention removes a curl of the medium by moving and returning the medium before it is issued plural times in a feed passage, which is curved in a direction to remove the curl of the medium. A medium handling method according to a seventh aspect of the invention guides a medium from medium accommodating parts, each accommodating the medium therein, upstream relative to a medium separating part, feeding the medium to the medium separating part for separating the medium one by one by the medium separating part when the medium is issued, then issuing the medium, wherein the medium is returned to a given amount to the medium accommodation parts before it is issued so as to remove the curl of the medium.

The sixth and seventh aspects of the invention can remove the curl of the medium to issue the medium without deforming the medium.

DETAILED DESCRIPTION OF

A medium handling according to an embodiment of the invention will be described hereinafter with reference to the attached drawings, which illustrate a ticket issuing apparatus for issuing tickets while it is connected with a host machine. Components which are common to each drawing are denoted by the same numerals.

Figure 1:
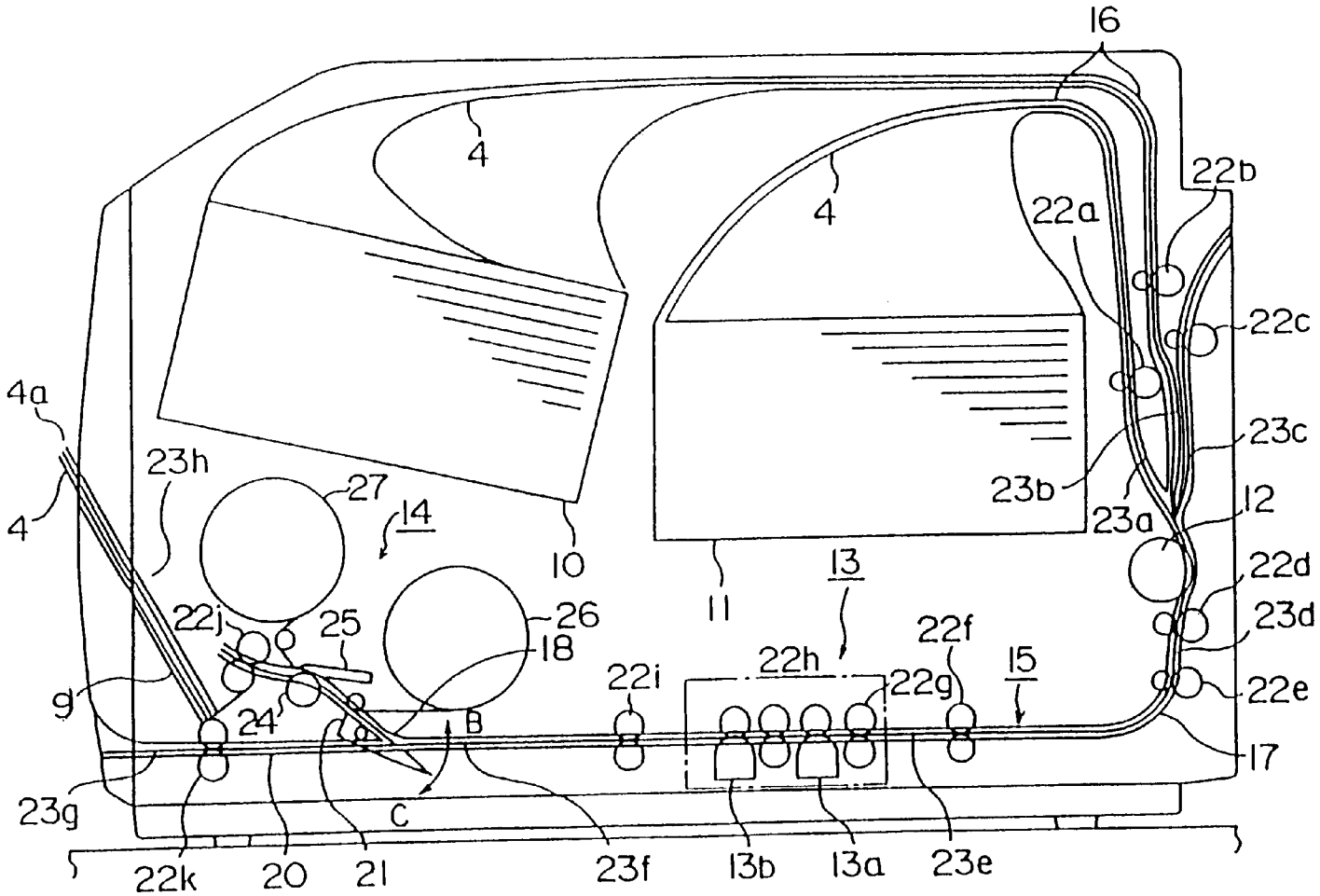
FIG. 1 is a schematic layout view showing a ticket issuing apparatus according to an embodiment of the present invention.
Figure 2:
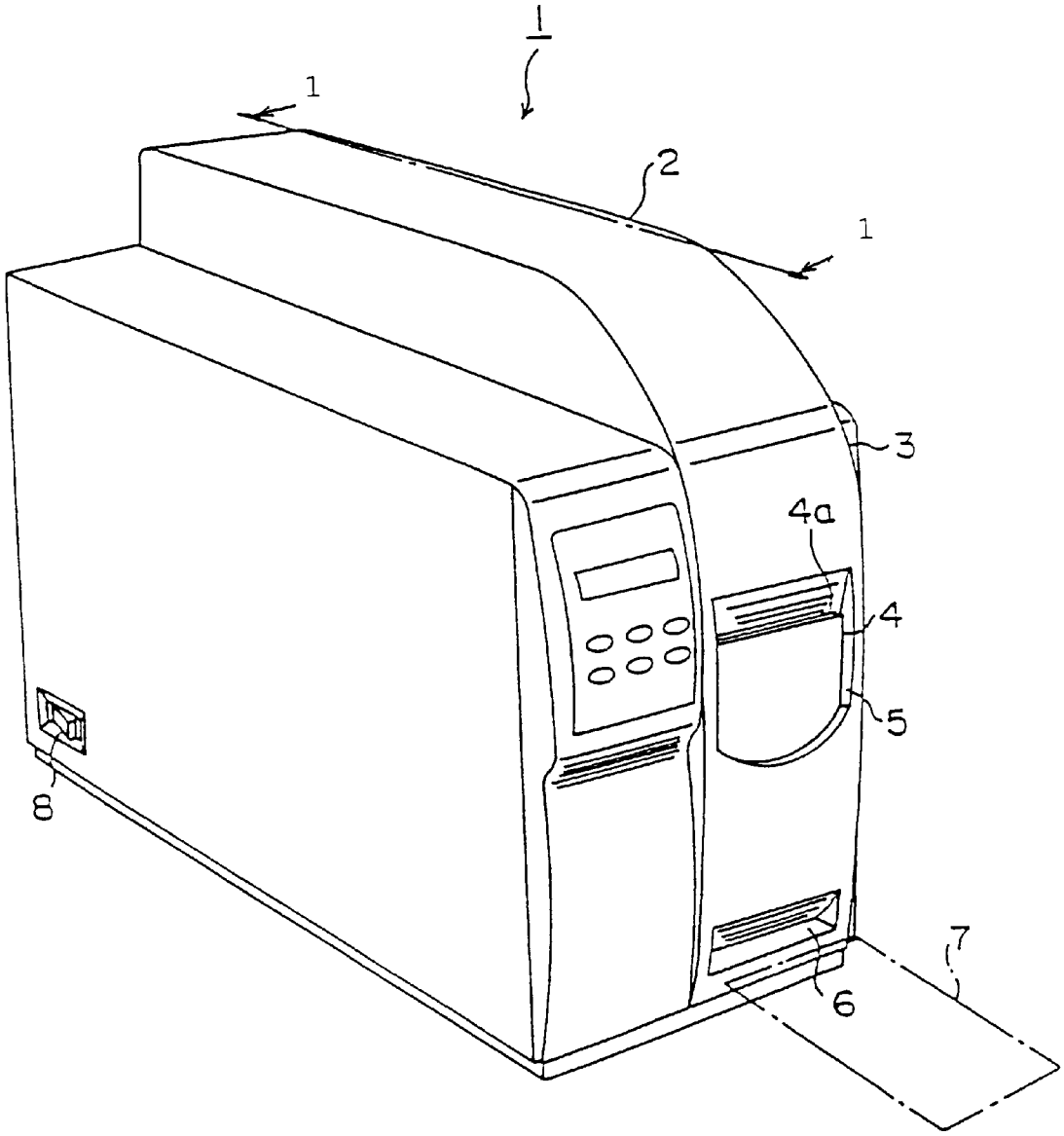
FIG. 2 is a perspective view showing an external appearance of the ticket issuing apparatus.

FIG. 1 is a schematic layout view showing a typical structure of a ticket issuing apparatus according to a first embodiment of the present invention. FIG. 2 is a perspective external view of the ticket issuing apparatus. FIG. 1 corresponds to the figure taken along the arrow I—I in FIG. 2.

The external structure of the ticket issuing apparatus will be now described with reference of FIG. 2.

FIG. 2 illustrates a ticket issuing apparatus 1, a housing 2, an operation panel 3, a ticket sheet 4, a ticket issuance port 5, a ticket insertion port 6, a ticket to be inserted 7, and a power source switch 8.

The ticket issuing apparatus 1 has the operation panel 3 at the front wall of the housing 2. The operation panel 3 has the ticket issuance port 5 for issuing the ticket sheet 4 and also has the ticket insertion port 6 under the ticket issuance port 5 for inserting an airline ticket, for example when it is changed to a boarding ticket. The ticket to be inserted from the ticket insertion port 6 is hereinafter referred to as the ticket 7. The ticket 7 is a medium which is differentiated in length depending on a kind thereof.

The ticket issuing apparatus 1 has the power source switch 8 at the rear portion of the side wall of the housing 2.

The ticket issuing apparatus 1 is structured to be divided into a main body and a side cover along the cut line 1—1, and it is illustrated in FIG. 1 where the side cover is removed from the main body.

An internal structure of the ticket issuing apparatus 1 will be now described with reference to FIG. 1.

FIG. 1 illustrates perforations 4*a*, a discharge stacker 9 hoppers 10 and 11, a medium separating roller 12 is a magnetic processing part 13 magnetic heads 13*a* and 13*b* a printing part 14, a feed passage 15 a first circular arc-shaped part 16, a second circular arc-shaped part 17 a third circular arc-shaped part 18, a leaf spring 19, a branched path 20 is a blade 21, feed rollers 22*a* to 22*k* sensors 23*a* to 23*g* platen rollers 24 head 25*a* a ribbon rewinding part 26, and a ribbon rewinding part 28.

The ticket issuing apparatus 1 has the discharge stacker 9 inside the ticket issuance port 5 so that the ticket sheet 4 is issued through the ticket issuance port 5 while the perforations 4a of the ticket sheet 4 protrude upward from the ticket issuance port 5. The discharge stacker 9 is disposed aslant inside the ticket issuance port 5. This allows the ticket sheet 4 to be discharged in a state where it is lined up so that a client can easily receive the ticket sheet 4, and ensures that the discharge stacker 9 does not protrude outside the apparatus so that the apparatus can be made with a small sized.

The ticket issuing apparatus 1 has the hoppers 10 and 11, medium separating roller 12, magnetic processing part 13 and printing part 14 in the housing 2. These components are disposed in the manner that the hoppers 10 and 11 and the medium separating roller 12 are disposed behind the ticket issuance port 5, which is disposed at the front wall of the apparatus, toward the back of the ticket issuing apparatus 1 in this order and arranged adjacent to one another. The magnetic processing part 13 and printing part 14 are disposed under the hoppers 10 and 11, while the former is in parallel with the latter. The hoppers 10 and 11 can accommodate therein rectangular tickets which are folded at perforations and have different lengths. The ticket issuing apparatus 1 draws out the ticket sheets 4 from the hoppers 10 and 11 to guide them to the medium separating roller 12. The medium separating roller 12 has a double-cone shape having the maximum diameter at the center thereof and the minimum diameter at both ends thereof The medium separating roller 12 separates the ticket sheet 4, one by one, along every set of perforations. The ticket issuing apparatus 1 feeds the ticket sheet 4, which is separated one by one by the medium separating roller 12, to the magnetic processing part 13. The magnetic processing part 13 writes a given magnetic data into a magnetic stripe provided at the back of the ticket sheet 4 by a write magnetic head 13*a*, and reads the magnetic data by a read magnetic head 13*b*, and then it checks whether the magnetic data is written correctly or not. The ticket issuing apparatus 1 feeds the ticket sheet 4, magnetic data of which was checked by the magnetic processing part 13, to the printing part 14. The printing part 14 is a thermal printer for printing a given printing data onto the front of the ticket sheet 4 in a printing position. The ticket issuing apparatus 1 feeds the ticket sheet 4, onto which a given printing data was printed by the printing part 14, to the discharge stacker 9. The discharge stacker 9 discharges the ticket sheet 4 while lining up the ticket sheet 4 so that the perforations 4*a* of the ticket sheet 4 are directed upward to be jumped and issued through the ticket issuance port 5.

Figure 3:
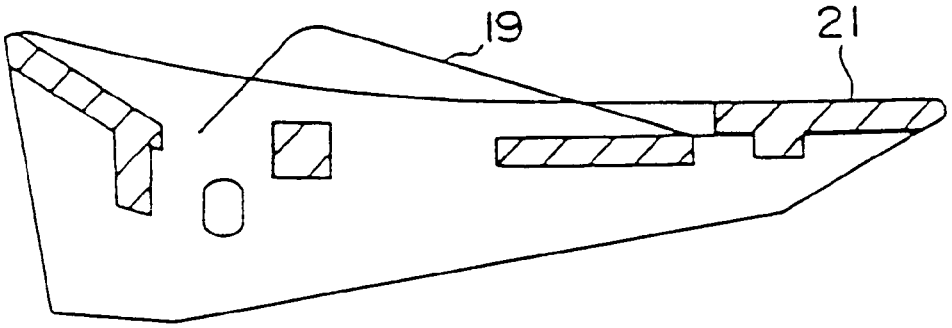
FIG. 3 is a detailed cross sectional view showing a blade.

The ticket issuing apparatus 1 has the feed passage 15 inside the housing 2. The feed passage 15 is disposed so that it passes through the upper, rear and lower portions of the hoppers 10 and 11 in this order, and is guided to the ticket issuance port 5 disposed at the front wall of the apparatus. Meanwhile, the medium separating roller 12, magnetic processing part 13 and printing part 14 are disposed along the feed passage 15, while the discharge stacker 9 is disposed at the end of the feed passage 15. The feed passage 15 is branched into plural guides (guide passages) at one end thereof, which are respectively connected with the respective hoppers 10 and 11 and arranged in strata. The feed passage 15 is formed in a manner that one end thereof is branched to form plural guides, which are changed in a direction to be substantially perpendicular to their original direction by the first circular arc-shaped part 16, then the plural guides are merged into one so as to guide the ticket sheet 4 to the medium separating roller 12. Further, the feed passage 15 is formed so that the portion between the medium separating roller 12 and magnetic processing part 13 is changed in a direction to be substantially perpendicular to its prior direction by the second circular arc-shaped part 17. Still further, the feed passage 15 is formed in the manner that the portion between the magnetic processing part 13 and printing part 14 is changed in a direction by the third circular arc-shaped part 18 so that the printing part 14 is in parallel with the discharge stacker 9. The feed passage 15 is thus structured so that the ticket sheet 4 is not drawn out in a bellows shape when it is guided from the hoppers 10 and 11 to the medium separating roller 12. The feed passage 15 is curved between the hoppers 10 and 11 and the first circular arc-shaped part 16, and is also curved between the first circular arc-shaped part 16 and medium separating roller 12 in the direction opposite thereto. There is a possibility that the ticket sheet 4 fed on the feed passage 15 will be curled along the feed passage 15 between the hoppers 10 and 11 and the first circular arc-shaped part 16. The feed passage 15 can remove the curl of the ticket sheet 4 while moving and returning the ticket sheet 4 plural times between the first circular arc part 16 and the medium separating roller 12. The feed passage 15 is connected with the branched path 20 communicating with the ticket insertion port 6, through which the ticket 7 is inserted, at the third circular arc-shaped part 18. The ticket 7 inserted into the inside of the apparatus through the ticket insertion port 6 is fed upstream relative to the magnetic processing part 13, and then it is returned. A given magnetic data is written into the ticket 7 by the magnetic processing part 13, a given printing data is printed onto the ticket 7, and finally it is discharged through the discharge stacker 9. The feed passage 15 has the blade 21 for switching the feeding direction of the ticket sheet 4 and that of the ticket 7 at a merging part of the feed passage 15 and the branched path 20. The blade 21 is made of a resin material and is formed of a plurality of blade pieces which are disposed in a width direction of the ticket sheet 4 to be integrated with one another by a beam. The blade 21 is disposed at the merging part between the feed passage 15 and the branched path 20 so as to be freely turned about an axle, and it is driven by an electromagnetic solenoid, described later. The blade 21 is turned in the direction of the arrow B when the electromagnetic solenoid is turned on and it is turned in the direction of the arrow C by a bias spring (not shown) when the electromagnetic solenoid is turned off. The leaf spring 19 (see FIG. 3) is fixed to the blade 21. The leaf spring 19 is a pressing member which is disposed to prevent the ticket sheet 4 from being varied in its printing position which is caused by the swelling in moving distance of the ticket sheet 4 when the ticket sheet 4 passes through the third circular arc-shaped part 18 presses the ticket sheet 4 against an upper feeding guide of the feed passage 15 to make the feeding distance of the ticket sheet 4 constant. The pressing member, such as the leaf spring 19, can be disposed at either the upper or lower feeding guide of the feed passage 15 so as to press the ticket sheet 4 against either the upper or lower feeding guide. Further, the pressing member can be disposed at circular arc-shaped parts other than the third circular arc-shaped part 18. However, it is particularly effective when it is disposed at the spot where the moving distance of the ticket sheet 4 is required to be constant. Furthermore, the pressing member can be employed by a medium handling apparatus other than the ticket issuing apparatus 1, such as a copying machine, an optical character reader (OCR), and an automated teller machine (ATM).

The ticket issuing apparatus 1 has, as shown in FIG. 1, a feeding pass at the rear wall of the housing 2 for guiding the ticket sheet 4 from an optional hopper (not shown) provided outside the apparatus to inside of the apparatus. The ticket issuing apparatus 1 guides the ticket sheet 4 which is guided from the optional hopper to the medium separating roller 12, then it separates the ticket sheet 4, one by one, along every perforation 4*a*. In FIG. 1, the medium separating roller 12 is disposed behind the hoppers 10 and 11. The medium separating roller 12 may be disposed at a variety of locations but it is preferable to dispose roller 12 behind the hoppers 10 and 11 because of the following reason. That is, since the medium separating roller 12 guides the ticket sheet 4, which may be accommodated in the optional hopper provided outside the apparatus to the inside of the apparatus, to separate the ticket sheet 4, and likewise guides the ticket sheet 4 which is accommodated in the hoppers 10 and 11 provided inside the apparatus, it is preferred that the roller 12 be disposed behind or under the hoppers 10 and 11. However, if the medium separating roller 12 is disposed under the hoppers 10 and 11, it is difficult to dispose the magnetic processing part 13 and printing part 14, which respectively have large sizes in the small apparatus. Accordingly, the medium separating roller 12 is preferably to be disposed behind the hoppers 10 and 11.

Figure 4:
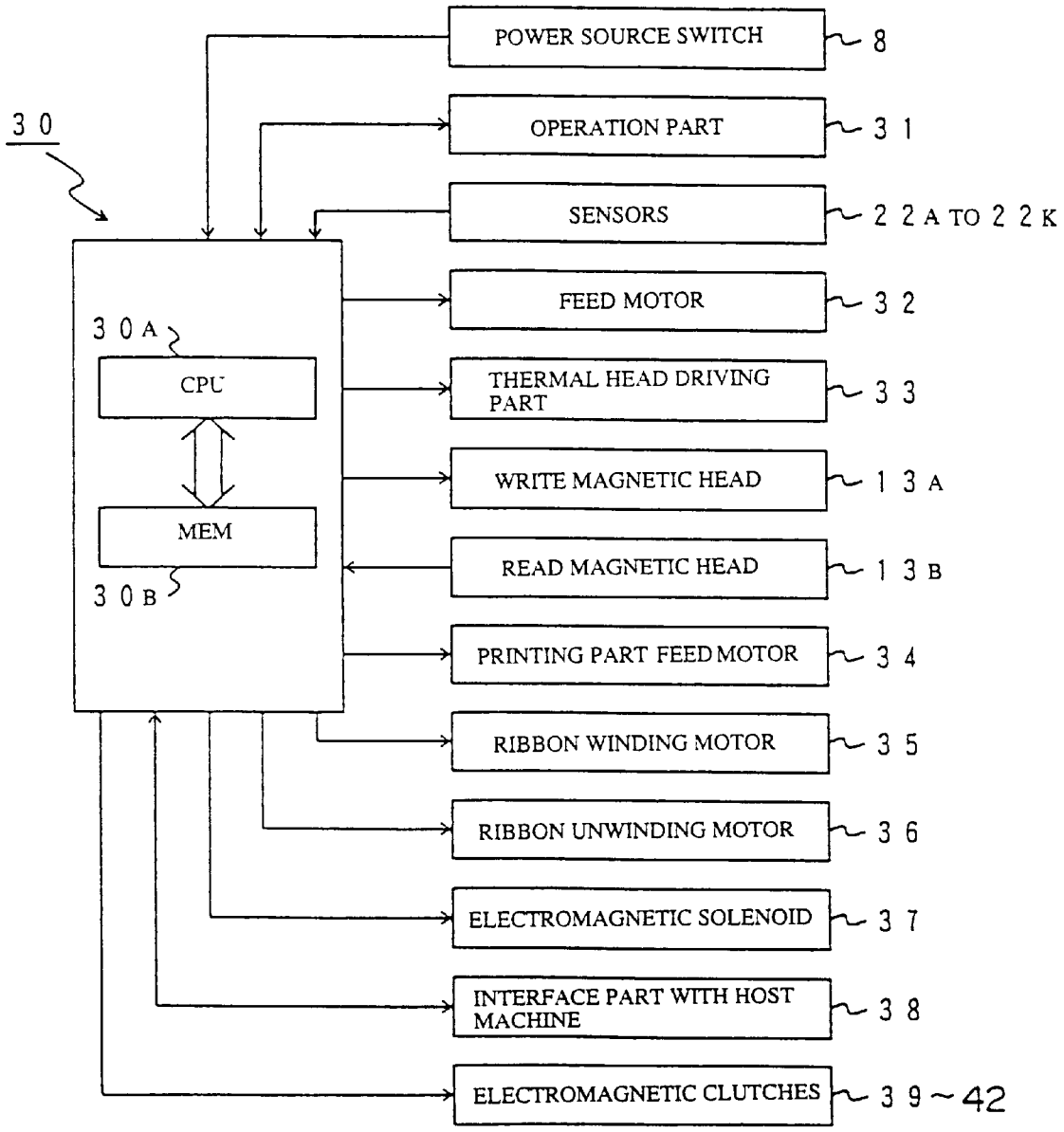
FIG. 4 is a block diagram showing the control of the ticket issuing apparatus.

The ticket issuing apparatus 1 has the feed rollers 22*a* to 22*k* on the feed passage 15 rollers 22*a* to 22*k* are spaced at a given interval and paired with pressing rollers while intervening the feed passage 15 as a feeding mechanism. The feed rollers 22*a* to 22*k* are rotated by a belt (not shown) which is stretched and wound between them and the feed motor, described later. Particularly, the feed rollers 22*a* to 22*c* and 22*e* are fixed to a rotary shaft which is coaxially provided with an axle to which a gear wheel (not shown) meshing with the belt which is rotated by the feed motor is fixed, and they are rotated in synchronization with the rotation of the motor when electromagnetic clutches, described later, are turned on. A gear ratio between the feed rollers 22*a* to 22*c* is varied so that the feed rollers 22*a* to 22*c* are rotated slower than the feed roller 22*e*. A belt (not shown) is wound around the feed roller 22*d* so that it is synchronized with and rotated at the same speed as the feed roller 22*e*. Referring also to FIG. 4, these rollers operate as follows when the ticket sheet 4 is issued, e.g. from the hopper 10. When the electromagnetic clutches 40 and 42 of the feed rollers 22*b* and 22*e* are turned on to rotate the feed motor, the feed rollers 22*b*, 22*d* and 22*e* are rotated in synchronization with the rotation of the feed motor to feed the ticket sheet 4 to the medium separating roller 12. At this time, since the electromagnetic clutches 39 and 41 of the feed rollers 22*a* and 22*c* are turned off, the feed rollers 22*a* and 22*c* are not rotated.

The ticket issuing apparatus 1 has sensors 23*a* to 23*g* for detecting the ticket sheet 4 on the feed passage 15, and also has a sensor 23*h* in the discharge stacker 9 for detecting a full state (e.g., 50 pieces), that is, when the ticket sheets 4 discharged to the discharge stacker 9 completely fill stacker 9. The sensors 23*a*, 23*b*, and 23*c* respectively detect the leading ends of the ticket sheets 4 respectively accommodated in the hoppers 10 and 11 and the optional hopper provided outside the apparatus. For example, when the ticket sheet 4 is set in the hopper 10 by an operator, the operator removes the side cover so that the rectangular ticket sheet 4 which is folded along the perforations 4*a* is accommodated in the hopper 10. When the leading end of the ticket sheet 4 is inserted from the hopper 10 into the feed passage 15, the sensor 23*b* detects the leading end of the ticket sheet 4. The sensor 23*d* detects the leading end of the ticket sheet 4 which is fed to the medium separating roller 12. For example, when the ticket sheet 4 is separated by the medium separating roller 12, one by one, along every set of perforation 4*a*, the sensor 23*d* detects the leading end of the ticket sheet 4. As a result, the electromagnetic clutch 40 of the feed roller 22*b* is turned off to permit the feed roller 22*b* to be in a free state. Thereafter, when the perforations 4*a* of the ticket sheet 4 reach the medium separating roller 12, the electromagnetic clutch 40 of the feed roller 22*b* is turned on so that the feed roller 22*b* is rotated. At this time, there is a difference between the rotating speed of the feed roller 22*b* and that of the feed roller 22*e*, which applies a load to the ticket sheet 4. Due to this load, the ticket sheet 4 is separated from the perforations 4*a*. The sensor 23*e* detects a timing when the ticket sheet 4, separated at the perforations 4*a*, is fed to the magnetic processing part 13. The sensor 23*e* also functions as a sensor for detecting the trailing edge of the inserted ticket, and hence it determines the length of the ticket 7 by detecting the leading and trailing ends of the ticket 7 which is inserted through the ticket insertion port 6. The sensor 23*f* detects the leading end of the ticket sheet 4 into which a given magnetic data is written by the magnetic processing part 13. When the sensor 23*f* detects the leading end of the ticket sheet 4, the ticket issuing apparatus 1 switches the blade 21 to feed the ticket sheet 4 to the printing part 14. The sensor 23*g* is disposed at the ticket insertion port 6 for detecting the ticket 7 inserted through the ticket insertion port 6.

The ticket issuing apparatus 1 has the platen rollers 24, the thermal head 25 which is pressed by the platen rollers 24 to print a given printing data onto the front of the ticket sheet 4, the ribbon rewinding part 26 for unwinding an ink ribbon, and the ribbon winding part 27 for winding the ink ribbon, which are respectably provided in the printing part 14.

FIG. 4 is a block diagram showing the control of the ticket issuing apparatus 1 according to an embodiment of the present invention.

The control procedure of the ticket issuing apparatus 1 will be now be described with reference with FIG. 4.

FIG. 4 schematically showns is a control part 30 a central processing unit (hereinafter referred to as CPU 30*a*), and a memory (hereinafter referred to as MEM 30*b*).

The control part 30 is connected with the power source switch 8, operation part 31, a group of sensors 22*a* to 23*k*, feed motor 32, thermal head driving part 33, write magnetic head 13*a*, read magnetic head 13*b*, printing part feed motor 34, ribbon winding motor 35, ribbon unwinding motor 36, electromagnetic solenoid 37, interface part 38 interfaced with a host machine (not shown) and electromagnetic clutches 39 to 42, etc. The electromagnetic clutches 39 to 42 corresponds to the feed rollers 22*a* to 22*c*, and 22*e* as set forth above.

The control part 30 comprises the CPU 30*a* and the MEM 30*b*. The control part 30 performs ticket issuance processing and ticket insertion processing upon reception of commands thereof from a host machine based on a control program stored in the MEM 30*b* when the CPU 30*a* initializes the apparatus while a reset button of the operation part 31 is depressed.

Figure 5:
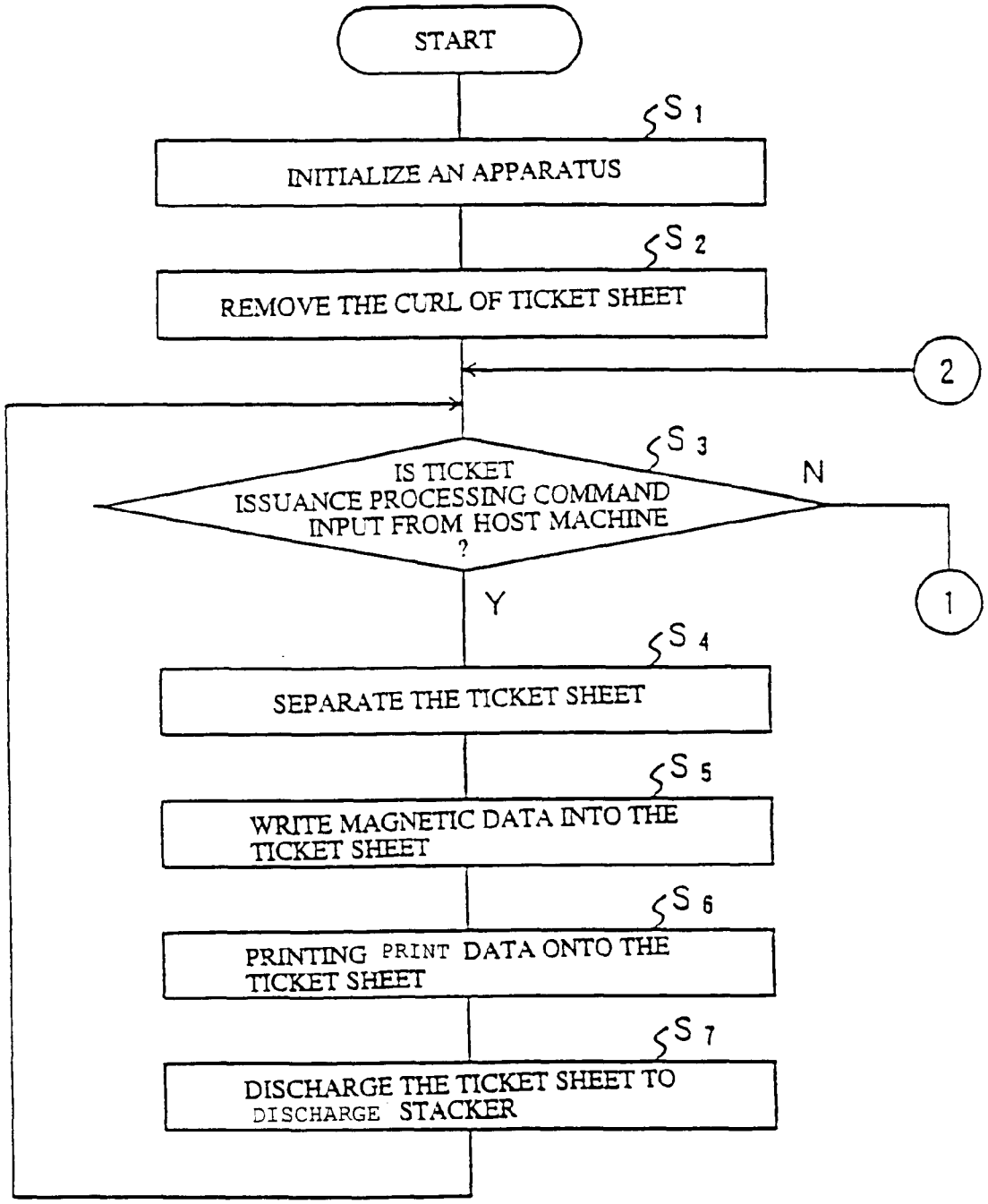
FIG. 5 is a first flow chart showing an operation of the ticket issuing apparatus.
Figure 6:
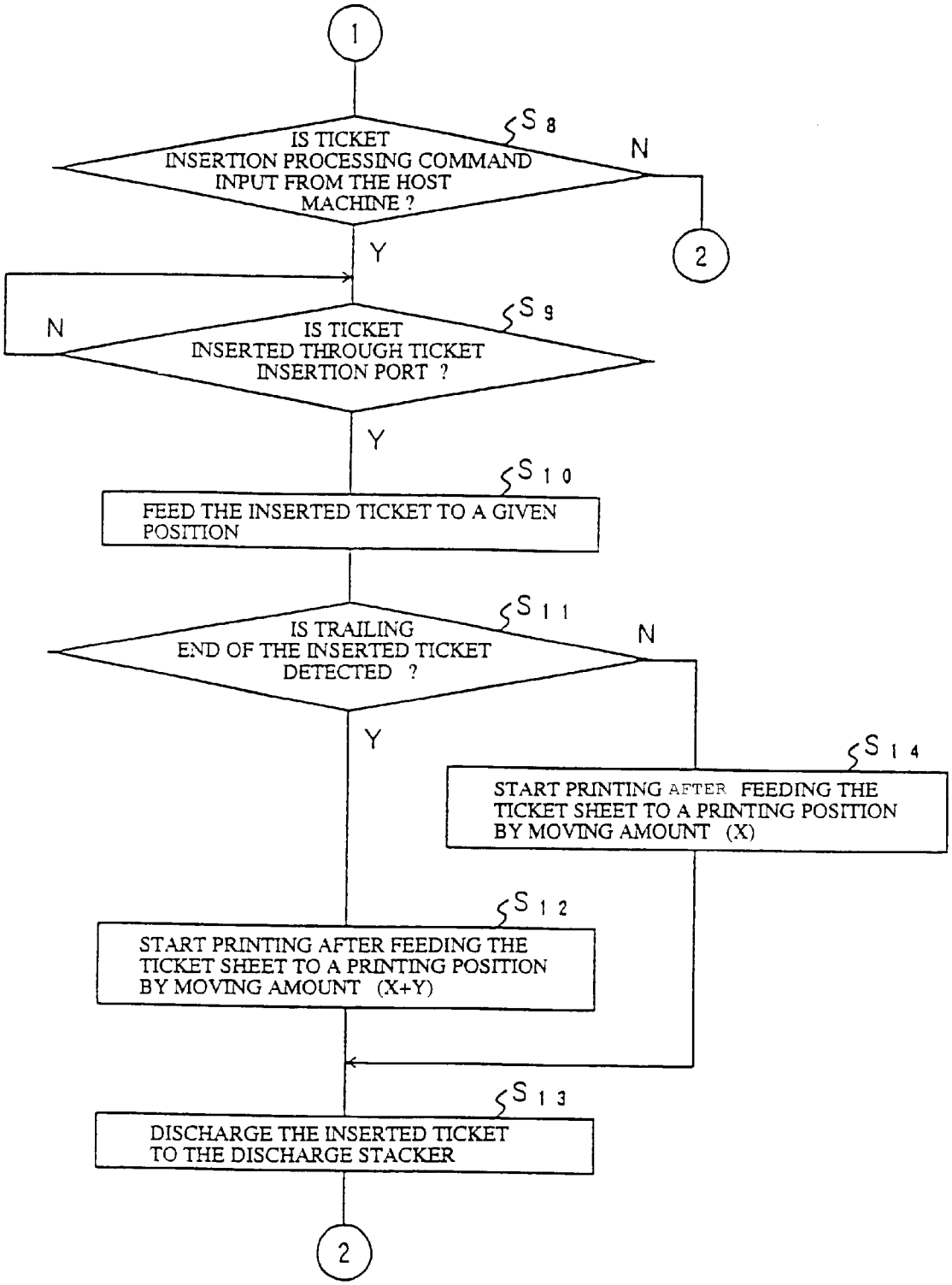
FIG. 6 is a second flow chart showing an operation of the ticket issuing apparatus.

FIG. 5 is a first flow chart for explaining the operation of the ticket issuing apparatus according to the present invention, and FIG. 6 is a second flow chart for explaining the operation of the ticket issuing apparatus according to the present invention. Each step is an operation of the CPU 30*a*.

The operation of the ticket issuing apparatus will be now described with reference with FIGS. 5 and 6.

When the power source switch 8 is turned on, the CPU 30*a* initializes the apparatus in step S1. (When the power source switch 8 is turned on, the apparatus is automatically initialized even if the reset button is not depressed).

In step S2, the CPU 30*a* normally or reversely rotates the feed motor 32 so as to move or return the ticket sheet 4 plural times between the sensor 23*a* and the feed roller 22*a* to remove the curl of the ticket sheet 4, and stops the leading end of the ticket sheet 4 in the position of the sensor 23*a* after the removal of the curl of the ticket sheet 4, then it is standby.

In step S3, the CPU 30*a* detects whether the ticket processing command is issued from the host machine or not. Step S3 is branched to step S4 when the ticket processing command is issued, and it is branched to step S8 when the ticket processing command is not issued. In step S4, the CPU 30*a* normally rotates the feed motor 32 to feed the ticket sheet 4 toward the medium separating roller 12. The leading end of the ticket sheet 4 is then deleted by the sensor 23*d*, and the ticket sheet 4 is separated by the medium separating roller 12 along the perforations 4*a*.

In step S5, the CPU 30*a* detects the leading end of the ticket sheet 4, which is separated along the perforations 4*a*, by the sensor 23*e*, then writes a given magnetic data into the magnetic stripe provided at the back of the ticket sheet 4 by the write magnetic head 13*a* while timing is provided, thereafter reads the written magnetic data by the read magnetic head 13*b*, thereby checking the magnetic data. In step S6, the CPU 30*a* detects the leading end of the ticket sheet 4 by the sensor 23*f* to turn the blade 21 in the direction of the arrow C, then it feeds the ticket sheet 4 to the printing part 14 where the ticket sheet 4 is printed while the ticket sheet 4 is pressed against the upper guide of the feed passage 15 by the leaf spring 19.

In step S7, the CPU 30*a* detects the ticket sheet 4 by the sensor 23*h*, then step S7 returns to step S3. In step S8, the CPU 30*a* detects whether the ticket insertion processing command is issued or not from the host machine. Step S8 is branched to step S9 when the ticket insertion processing command is issued, and it is branched to step S3 when the ticket insertion processing command is not issued. In step S9, the CPU 30*a* turns the blade 21 in the direction of the arrow B, then detects whether the ticket 7 is inserted through the ticket insertion port 6 or not via the sensor 23*g*. Step S9 goes to step S10 when the ticket 7 is inserted through the ticket insertion port 6.

In step S10, if the CPU 30*a* detects the leading end of the ticket 7 via the sensor 23*e*, it feeds the ticket 7 to a given position. In step S11, if the CPU 30*a* can detect the trailing end of the ticket 7 by the sensor 23*e*, step S11 is branched to step S12, but if it cannot detect the trailing end of the ticket 7, step S11 is branched to step S14. For example, when a printing data such as a seat number, etc. is printed onto an airline ticket to change to a boarding ticket, it is necessary to distinguish an airline ticket having a stitched part for correctly printing the printing data onto the airline ticket in a printing position from that having no such a stitched part.

In step S12, the CPU 30*a* detects the trailing end of the ticket 7 by the sensor 23*f* to turn the blade 21 in the direction of the arrow C. The printing is begun after feeding the ticket 7 to the printing position by moving ticket 7 the amount (X+Y) while the ticket 7 is pressed against the upper guide of the feed passage 15 by the leaf spring 19. In step S13, when the CPU 30*a* detects the ticket 7 by the sensor 23*h*, step S13 returns to step S3. In step S14, the CPU 30*a* detects the trailing end of the ticket 7 by the sensor 23*f* to turn the blade 21 in the direction of the arrow C, and starts the printing after moving the ticket 7 to the printing position by a moving amount of X while the ticket 7 is pressed against the upper guide of the feed passage 15 by the leaf spring 19.

Meanwhile, the blade which is biased by the bias spring is turned by the electromagnetic solenoid, but it may be brought into contact with the lower guide of the feed passage 15 due to its own weight while the leaf spring is brought into contact with the upper guide of the feed passage 15 so that the medium is fed to the printing part in this state. When the ticket 7 is inserted in this state, the blade may be pushed upward by the ticket 7. In this case, the electromagnetic solenoid and the bias spring are eliminated.

With the arrangement of the present invention set forth above, the following effects can be achieved.

The medium handling apparatus of the present invention is structured that the feed passage is branched into plural guides at one end thereof, which are respectively connected with each hopper and arranged in strata, then merged into one. Further, the medium handling apparatus is structured that the feed passage is disposed in the manner that it passes through the upper, rear and lower portions of a plurality of hoppers and is guided to the front wall of the apparatus, and the medium separating roller, magnetic processing part and printing part are respectively disposed along the feed passage, and the discharge stacker is connected with the other end of the feed passage. Since the medium handling apparatus is structured as such, it can be minimally sized to eleminate needless space, thereby making the apparatus small-sized. Particularly, since the one end of the feed passage connected with each hopper is formed in strata to change the direction of the feed passage between the hopper and the medium separating roller, thereby achieving the effect that the ticket sheet cannot be drawn out in the shape of bellows.

Further, according to the medium handling apparatus of the present invention, the insertion port through which the medium is inserted from the outside of the apparatus into the inside of the apparatus is provided under the discharge stacker provided at the front wall of the apparatus, thereby achieving the effect that an operator can insert the medium directly with his hands.

Furthermore, according to the medium handling apparatus of the present invention, the insertion port through which the medium is inserted from the outside of the apparatus into the inside of the apparatus is provided at the back wall of the apparatus, thereby achieving the effect that the medium can be guided from an optional hopper provided outside the apparatus into the apparatus.

Still further, according to the medium handling apparatus of the present invention, the pressing member for pressing the medium to the feeding guide is provided in the circular arc-shaped part disposed immediately before the printing part, thereby achieving the effect that the moving distance of the medium can be fixed so that the medium can be printed in a given printing position, thereby improving the printing quality.

Finally, according to the medium handling method of the present invention, the curl of the medium is removed by returning the medium before it is issued to the hopper by a given amount, thus removing the curl of the medium which is first issued, thereby achieving the effect that it does not make a client who receives the ticket feel unpleasant.

What is claimed is:

1. A ticket issuing apparatus that subjects a medium stored therein to a predetermined processing to make a ticket and to discharge the ticket to a stacker disposed at a front wall of the apparatus, comprising:

a plurality of hoppers, each for accommodating a plurality of the medium therein;

a plurality of guide passages collectively forming a first feed passage, the guide passages being disposed in strata and each guide passage having a respective first end connected with a respective hopper, and a respective second end, with each of the respective second ends of the plurality of guide passages merging together;

a second feed passage having an end connected with an end of the first feed passage in a region of the respective second ends of the guide passage, and having a further end connected with the stacker;

a separating device for separating the medium into a given size;

a magnetic processing device for writing a given magnetic data onto the medium; and a printing part for printing a given data onto the medium, wherein the first feed passage extends along an upper wall of the apparatus to an upper half of a rear wall of the apparatus, and along the upper half of the rear wall of the apparatus, and the second feed passage extends proximate to a lower half of the rear wall to a bottom wall of the apparatus and along the bottom wall of the apparatus, and wherein said separating device, said magnetic processing device and said printing part are disposed along the second feed passage.

2. The ticket issuing apparatus according to claim 1, further comprising:

an insertion port disposed at a back wall of the apparatus for inserting medium from an outside of the apparatus into the apparatus; and a third feed passage having one end connected with the insertion port, and another end connected with one of the first and second feed passages at a location behind the hoppers for feeding the medium inserted through the insertion port to the one of the first and second feed passages.

3. The ticket issuing apparatus according to claim 1, wherein the second feed passage includes an arc-shaped portion for changing a direction of the medium toward the stacker.

4. A ticket issuing apparatus according to claim 3, comprising:

a pressing member arranged at one of an upper and a lower part of the arc-shaped portion, and being disposed to press the medium against an opposing part of the second feed passage so as to make a feeding distance of the medium constant.

5. The ticket issuing apparatus according to claim 3, further comprising:

an insertion port disposed under the stacker for inserting medium from an outside of the apparatus into the apparatus; and a third feed passage having one end connected with the insertion port, and another end connected with the second feed passage at the arc-shaped portion for feeding the medium inserted through the insertion port to the second feed passage.

6. The ticket issuing apparatus according to claim 5, further comprising:

detecting means disposed on at least one of the second and third feed passage for determining a length of the medium inserted through the insertion port; and a blade disposed at the arc-shaped portion for directing the medium toward the stacker.

7. A ticket issuing apparatus that subjects a medium stored therein to a predetermined processing to make and issue a ticket, comprising:

a feed passage curved in a first direction; and another feed passage curved in a second direction opposite to the first direction, wherein the medium is passed through the feed passage curved in the first direction thereby forming a curl in the medium, and the medium is carried back and forth plural times in the another feed passage curved in the second direction so as to remove the curl of the medium, in issuing a ticket.

8. A ticket issuing apparatus that subjects a medium stored therein to a predetermined processing to make and issue a ticket, comprising:

a hopper;

a separating device; and a feed passage;

wherein, in issuing a ticket, a medium is carried in the feed passage from the hopper to a location upstream of the separating device, and then is returned a given amount toward the hopper, and through a curved portion of the feed passage so as to remove a curl of the medium before a ticket is issued, and then the medium is fed downstream to the separating device to be separated one by one.

* * * * *